US006761124B1

(12) United States Patent
Srinivasan

(10) Patent No.: US 6,761,124 B1
(45) Date of Patent: Jul. 13, 2004

(54) COLUMN-STABILIZED FLOATING STRUCTURES WITH TRUSS PONTOONS

(76) Inventor: Nagan Srinivasan, 3323 Double Lake Dr., Missouri City, TX (US) 77459

( * ) Notice: Subject to any disclaimer, the term of this patent is extended or adjusted under 35 U.S.C. 154(b) by 0 days.

(21) Appl. No.: 10/392,250

(22) Filed: Mar. 20, 2003

Related U.S. Application Data

(60) Provisional application No. 60/414,066, filed on Sep. 28, 2002.

(51) Int. Cl.[7] ..... B63B 35/44

(52) U.S. Cl. ..... 114/264; 114/265; 405/195.1

(58) Field of Search ..... 114/264, 265; 405/195.1

(56) References Cited

U.S. PATENT DOCUMENTS

RE29,167 E * 4/1977 Lloyd, III ..... 114/264
4,232,625 A * 11/1980 Goren et al. ..... 114/264
5,558,467 A * 9/1996 Horton ..... 405/195.1
5,722,797 A * 3/1998 Horton, III ..... 405/224
6,024,040 A * 2/2000 Thomas ..... 114/264
6,206,614 B1 * 3/2001 Blevins et al. ..... 405/224
6,652,192 B1 * 11/2003 Xu et al. ..... 405/195.1

* cited by examiner

*Primary Examiner*—Stephen Avila
(74) *Attorney, Agent, or Firm*—Kenneth A. Roddy

(57) ABSTRACT

Column-stabilized floating structures having a deck and a plurality of vertical buoyant caissons bridged together in distantly spaced relation by a plurality of open frame horizontal truss pontoon members and vertical truss columns at a lower end. The buoyancy of the caissons is selectively adjusted by means of ballast control. Water is selectively pumped into or out of keel tanks at the bottom of the truss structure such that the water mass and weight is adjustably tuned to raise or lower the center of gravity of the entire mass of the floating structure relative to its center of buoyancy. By tuning and positioning the center of gravity relative to the center of buoyancy, the floating structures can be tuned according to ballast and other variable or fixed loads including the deck payloads and to compensate for different operational, environmental, and survival conditions and towing and installation stages.

23 Claims, 13 Drawing Sheets

10C
DECK DRILLING
PRODUCTION
QUARTER MODULE
14
DECK
11B
11B
STILL W.L.
CENTER OF GRAVITY
(TUNED BY
KEEL TANK)
CENTER OF BUOYANCY
11A
11A
11
11
12
11C
11C
12A
12B
12B
13A
13A
13A
13A
17
MOORING LINE
MOORING LINE
13
13
KEEL TANK
KEEL TANK

COLUMN-STABILIZED FLOATING STRUCTURES WITH TRUSS PONTOONS

CROSS REFERENCE TO RELATED APPLICATION

This application claims priority of U.S. Provisional Application Serial No. 60/414,066, filed Sep. 28, 2002.

BACKGROUND OF THE INVENTION

1. Field of the Invention

This invention relates generally to apparatus and installation methods for semi-submersible vessels, tension leg platforms and floating structures, and more particularly to column-stabilized floating structures having a plurality of vertical spaced apart buoyant caissons connected together by an open framework of truss-pontoon members and the method of installation and operation.

2. Brief Description of the Prior Art

The word truss, as used herein, refers to a welded or bolted open frame structure formed of slender tubular members. Horizontally disposed truss structures are known as "truss pontoons", and vertically disposed truss structures are known as "truss columns". The truss bridges between three or more buoyant vertical column structures that stabilize a semi-submersible vessel at the water surface when floating with respect to wind, wave, current and other horizontal loads.

Semi-submersible type offshore floating vessels were first introduced in 1950. Ever since their introduction, the semi-submersible vessels have been found to be economical for offshore drilling, production, transport, pipe laying and other shallow and deep-water applications. SPAR, TLP, FPSO's and barges are other types of floating vessels that can be used for similar applications as semi-submersible vessels. Decks, columns and pontoons are the typical components of a semi-submersible vessel. Semi-submersible vessels comprise three or more large size vertical columns that are spatially separated and connected by large size horizontal pontoons between the columns at their bottoms. The deck structure is above the water with a sufficient air gap between the still water level to the bottom of the deck to allow waves to pass across the columns without impacting on the bottom of the deck. The center of gravity of the entire semi-submersible vessel is generally high due to large deck loads above the water. The deck of a semi-submersible vessel is a very conventional structure made of boxes, trusses and or girders fixed on top of the columns. The modern semi-submersible vessel uses pleated box structures for the deck with bulkheads, frames and stiffeners, in which case, the deck is called the upper hull. The column is a shell type plated structure with stringers, bulkheads and stiffeners.

The pontoon is also a shell type plated structure with frames, bulkheads and stiffeners. The pontoon and columns have compartments for ballast, voids and storages. The column and the pontoon together is called lower hull. The lower hull provides the necessary buoyancy to the semi-submersible to take the functional structural, equipment and live loads. The vertical columns are sized and located apart to provide water plane area and to provide the area moment of inertia. Since the center of the gravity of the semi-submersible vessel is much higher above the center of buoyancy of the lower hull, the acting moments due the wind, wave and currents horizontal forces are restored by the semi column water plane areas and moment of inertia of the water plane areas. The size and the spacing of the columns provide these two stability parameters. Thus the semi-submersible design is called a "column-stabilized floating unit". The semi-submersible vessel is a free-floating vessel compliant to wind, waves and currents. It is moored and/or dynamically positioned by powered-thrusters.

Semi-submersible vessels have good sea-keeping behavior with respect to waves and have large deck areas and carrying capacity. However the current and wind resistance results in higher positioning. A semi-submersible vessel is sensitive to the variable deck loads and its stability is limited. Semi-submersibles have large heave motions (vertical oscillation of the floating vessel) when subjected to waves and consequently a dry-tree oil production system is not feasible. In the case of a drilling semi-submersible, downtime of drilling may occur when the heave motion is not feasible for drilling.

Thomas, U.S. Pat. No. 6,024,040 discloses a mobile jack-up platform converted to a semi-submersible offshore platform. The platform includes single submerged hollow lower base at the bottom end, partially submerged elongate vertical buoyant connecting legs extending upwardly therefrom and passing through an upper barge (jack-up platform) above the level of the sea. The hollow base has a square, rectangular or triangular configuration and is filled with seawater to form the ballast for the entire platform and may include interior reservoirs in which hydrocarbons are stored. A central opening or passage in the center of the base reduces the resistive surface size of the base in the water during vertical movements of the platform. The vertical connecting legs have a hollow cylindrical upper portion with a bottom wall forming a buoyancy tank, and a lower portion formed of open frame lattice construction. The respective lengths of the hollow cylindrical buoyant upper portion and the lattice-work lower portions are dimensioned relative to one another so that a pressure force exerted by the sea on the upper portions substantially compensates for an acceleration force exerted on the base by the action of the seawater surrounding the base over a usual swell period range of the sea. The platform in operation imitates a semi-submersible, which can retract the legs with respect to the upper barge (jack-up platform). With the legs fully retracted above the upper barge and its single lower base closely adjacent to the bottom of the upper barge, the platform can be floated and transported to another location.

The tension leg platform (TLP) was introduced as a new concept based on a semi-submersible design with a deck, columns or caissons and pontoons. The vertical heave of the tension leg platform (TLP) is reduced by tendons attached between the lower hull and the seabed. The tendons are always maintained in tension with the excess buoyancy designed into the lower hull. The application of a TLP is limited to water depths of say 5000 ft., over which, the tendons' vertical neutral period enters the energetic portion of the wave heave forces of the TLP. Secondly, the size of the lower hull increases the economics to always maintain tension in the tendons with respect to the increased water depth.

The SPAR is currently used in relatively large offshore oil production applications. The SPAR is a single large vertical column or caisson buoyant structure. Unlike the semi-submersibles, the stability of the vessel is not dependent on the water plane area and the moment of inertia of the water plane area. The stability of the SPAR is provided by lowering the center of gravity of the vessel below its center of buoyancy. Thus, the vertical buoyancy acts upwards above the center of gravity, and total weight acts at the center of gravity below the center of buoyancy. The SPAR has excellent heave performance like a TLP and dry-tree production systems like a fixed offshore platform are used. However, the SPAR has limitation in deck area and payload due to the size of the SPAR. The SPAR is fabricated and transported horizontally and up-ended vertically at the operating location. Then the fully equipped deck is installed on top of the SPAR vertical column. Thus the transportation and installation cost and risk are significantly increases with water depth and deck payload applications. The SPAR becomes uneconomical for larger production as a self-contained drilling unit in deepwater. Ultra deepwater posses problems to the riser tensioning system and limits the applicability of the SPAR. Mooring of the SPAR in deepwater over 5000 ft also posses a serious problem. The effectiveness of the mooring and handling are reduced in such water depth. The SPAR also poses vortex shedding vibration problems when the vertical single column hull becomes extremely slender.

Horton, U.S. Pat. No. 5,558,467 discloses a spar-type deep water offshore floating apparatus, for use in oil drilling and production in which an upper buoyant hull of prismatic shape is provided with a passage longitudinally extending through the hull in which risers run down to the sea floor, the bottom of the hull being located at a selected depth dependent upon the wind, wave, and current environment at the well site, which significantly reduces the wave forces acting on the bottom of the hull, a frame structure connected to the hull bottom and extending downwardly and comprising a plurality of vertically arranged bays defined by vertically spaced horizontal water entrapment plates and providing open windows around the periphery of the frame structure, the windows providing transparency to ocean currents and to wave motion in a horizontal direction to reduce drag, the vertical space between the plates corresponding to the width of the bay window, the frame structure being below significant wave action whereby wave action thereat does not contribute to heave motion of the apparatus but inhibits heave motion, the frame structure serving to modify the natural period and stability of the apparatus to minimize heave, pitch, and roll motions of the apparatus. A keel assembly at the bottom of the frame structure has ballast chambers for enabling the apparatus to float horizontally and for stabilization of the apparatus against tilting in vertical position, and taut anchor lines connected to the apparatus at allocation of relatively little cyclic movement of the apparatus, the said lines being connected to suitable anchors. Horton, III, U.S. Pat. No. 5,722,797 discloses a spar-type buoyant floating caisson for offshore drilling and production that includes means for increasing the natural period of the caisson and reducing heave, pitch, and roll without increasing the overall length of the caisson. The floating caisson has a center well through which drilling and/or production risers pass and one or, more circular plates extend radially from the caisson below the water surface. The circular plates provide additional mass and resistance to environmentally induced motions and thus increases the natural period of the caisson beyond the periods of maximum wave energy, which allows the caisson to be designed with a shallower draft than a caisson without the plates that would normally be used in deep water.

Blevins et al, U.S. Pat. No. 6,206,614 discloses a spar-type floating offshore drilling/producing structure that is formed from a plurality of closely spaced vertically oriented buoyant columns on which one or more modules or decks may be placed to support process equipment, a drilling rig, utilities, and accommodations for personnel. The columns are held in the closely spaced relationship by a plurality of horizontal plates spaced along the length of the columns and vertical plates located near the bottom of the columns and near the top of the columns. The columns have a smaller water plane area than the horizontal plates. The structure includes fixed ballast, an oil storage area, and voids and variable ballast for offsetting the lighter weight of the stored oil.

A long-felt need exists for an improved offshore platform that can economically support a deck in deepwater and respond efficiently to the environmental forces in ultra deepwater. An ideal vessel for a deepwater application requires: a large deck area, large carrying capacity, less heave response to waves, excellent wind and wave current motion behavior so that a dry-tree production system is feasible, less station keeping forces, and finally, less construction costs.

The present invention is distinguished over the prior art in general, and these patents in particular by a new concept for offshore drilling, production, transportation and other applications with the above noted key principle requirements for a feasible economical system. The present structure herein referred to as "column-stabilized floating structures with truss pontoons" has a deck and a plurality of vertically oriented buoyant columns or caissons bridged together in distantly spaced relation a plurality of open frame horizontal truss pontoon members and vertical truss columns at a lower end. Each of the buoyant caissons has a submerged portion and a non-submerged portion with one or more buoyant tanks or chambers enclosed by bulkheads or entrapped inside the columns or caissons, the buoyancy of which can be selectively adjusted by means of ballast control. Water is selectively pumped into or out of keel tanks at the bottom of the truss structure such that the water mass and weight is adjustably tuned to raise or lower the center of gravity of the entire mass of the floating structure. By tuning and positioning the center of gravity relative to the center of buoyancy, the present floating structures can be tuned according to ballast and other variable or fixed loads including the deck payloads and compensate for different operational, environmental, and survival conditions and towing and installation stages of the floating structure.

The present column-stabilized floating structures having buoyant caissons with horizontal truss pontoons and vertical truss columns provides a large deck area and deck payload like a conventional semi-submersible, and low heave response to waves and environmental forces like a SPAR vessel. Thus, the present invention has all of the advantages of a semi-submersible and a SPAR vessel. However, unlike the SPAR vessel concept, which requires the center of gravity to be below the center of buoyancy in order to achieve the required stability when floating, the center of gravity of the present structure can be selectively positioned above the center of buoyancy and is stabilized by distantly positioned buoyant caissons, similar to a semi-submersible vessel. By the fundamentals of the principles of the stability criteria, the present invention does not belong to the family of SPAR structures but stabilized by its multiple columns water plane area and the moment of inertia of the water plane area. Spacing the columns well apart increases the moment-of-inertia of the water-plane-area of the water piercing columns. Thus the present invention is called a column stabilized floating structure with truss pontoons.

SUMMARY OF THE INVENTION

It is therefore an object of the present invention to provide an offshore column-stabilized floating structure that can economically support a large deck area in deepwater and responds efficiently to environmental forces in ultra-deepwater.

It is another object of this invention to provide a column-stabilized floating structure that has a large carrying capacity and excellent heave response to wind and waves thereby making a dry-tree oil production system economically feasible.

Another object of this invention is to provide a column-stabilized floating structure that is stabilized by buoyant columns or caissons and allows the center of gravity to be above the center of buoyancy in order to achieve stability when floating.

Another object of this invention is to provide a column-stabilized floating structure wherein the center of gravity and weight of the structure can be adjustably tuned as desired to achieve a proper height by pumping water in and out of the keel tanks of the structure.

Another object of this invention is to provide a column-stabilized floating structure that has a low lower hull weight, reduced fabrication cost, and large payload to hull displacement ratio.

Another object of this invention is to provide a column-stabilized floating structure that has low mooring or DP positioning forces, less plated shell type structure and fatigue sensitive spots, and greater residual structural strength than conventional semi-submersible vessels.

A further object of this invention is to provide a column-stabilized floating structure that is insensitive to variable deck loads, allows all equipment and consumable fluids to be located on the deck, and has no risk of damage by dropped objects.

A still further object of this invention is to provide a column-stabilized floating structure that reduces engineering cost, reduces fatigue damages, is economical to manufacture, operate, and maintain.

Other objects of the invention will become apparent from time to time throughout the specification and claims as hereinafter related.

The above noted objects and other objects of the invention are accomplished by a column-stabilized floating structure having a deck and a plurality of vertically oriented buoyant caissons bridged together in distantly spaced relation by a plurality of open frame horizontal truss pontoon members and vertical truss columns at a lower end. Each of the buoyant caissons has a submerged portion and a non-submerged portion with one or more buoyant tanks or chambers enclosed by bulkheads or entrapped inside the columns or caissons, the buoyancy of which can be selectively adjusted by means of ballast control. Water is selectively pumped into or out of the keel tanks at the bottom of the truss structure such that the water mass and weight is adjustably tuned to raise or lower the center of gravity of the entire mass of the floating structure. By tuning and positioning the center of gravity relative to the center of buoyancy, the present floating structures can be tuned according to ballast and other variable or fixed loads including the deck payloads and compensate for different operational, environmental, and survival conditions and towing and installation stages of the vessel.

DESCRIPTION OF THE PREFERRED EMBODIMENTS

Figure 1:
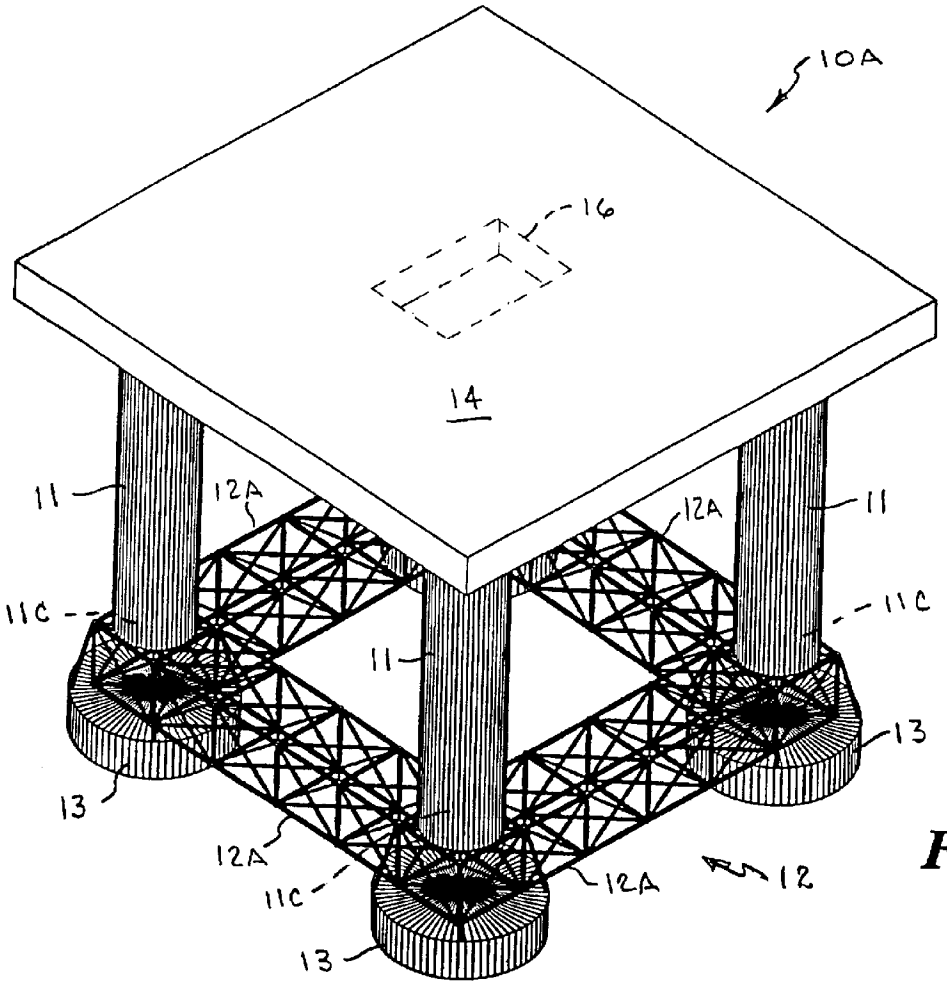
FIG. 1 is a schematic perspective view of a mobile offshore platform or vessel embodiment of the column-stabilized floating structure with horizontal truss pontoons in accordance with the present invention having fixed keel tanks.
Figure 2:
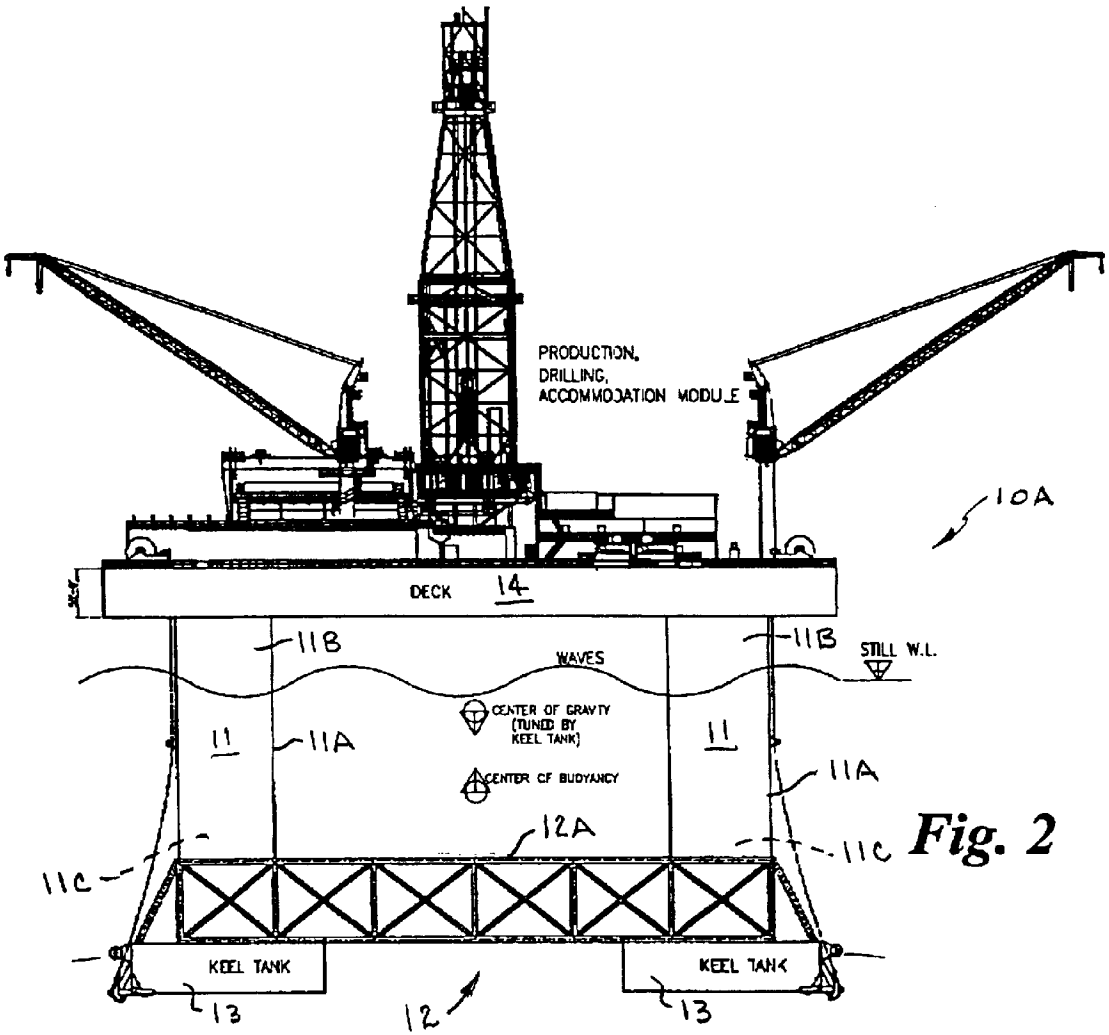
FIG. 2 is a schematic side elevation of the column-stabilized floating structure of FIG. 1 with a typical equipment set-up shown on the top of the deck.

FIGS. 1 and 2 illustrate a preferred mobile drilling platform or vessel embodiment 10A of the column-stabilized floating structure with truss pontoons, which may be utilized as a semi-submersible or Tension Leg Platform (TLP). The present column-stabilized floating structure 10A has a plurality of vertically oriented buoyant columns or caissons 11 bridged together in distantly spaced relation by a plurality of open frame truss structures 12 formed of slender tubular members connected to the lower ends of the buoyant caissons 11 by welding, bolting, pinning or other conventional assembly methods. In this embodiment, the open frame truss structure 12 is a plurality of horizontally disposed open frame truss structures, hereinafter referred to as "horizontal truss pontoons" 12A.

The horizontal truss pontoons 12A form a generally rectangular open framework at the bottom of the caissons 11. Unlike conventional deep draft semi-submersible and tension leg platforms, the buoyant caissons 11 are not connected by horizontal stiffened shell box pontoons but, instead, are bridged together by the heavy open frame truss framework of the horizontal truss-pontoons 12A.

Each of the vertical buoyant caissons 11 has a submerged portion 11A and a non-submerged portion 11B with one or more buoyant tanks or chambers 11C enclosed by bulkheads or entrapped inside the buoyant caissons, the, buoyancy of which can be selectively adjusted by means of ballast control. Buoyant caissons are conventional in the art and therefore the structural details and components thereof are not shown in detail.

Keel tanks 13 are supported at the bottom of the horizontal truss pontoons 12A, each spaced vertically below a respective one of the buoyant caissons 11. Water may be selectively pumped into and out of the respective keel tanks 13 by pumps and pump control mechanisms, which are conventional in the art, and therefore not shown in detail. By pumping water into or out of the keel tanks 13, the collective water mass of the keel tanks 13 and thus the weight of the structure, is adjustably tuned to raise or lower the Center of Gravity (C.G) of the entire mass of the floating structure 10A according to ballast and other variable or fixed loads including the deck payloads.

The Center of Gravity (C.G.) of the floating structure with respect to its Center of Buoyancy (C.B) plays an important role in the stability and motion of the floating structure. Thus, by controlling the mass of the water in the keel tank 13 the center of gravity (C.G.) and the center of buoyancy (C.B.) of the present floating structure can be tuned to their desired locations and to compensate for different operational, environmental survival and installation stages of the floating structure.

The present column-stabilized floating structure 10A can be moored or dynamically positioned by thrusters (not shown) placed on the underwater portion of the floating structure. A deck 14 of box, truss, or frame type is disposed above, and fixed to, the buoyant caissons 11 to carry the designed payload with super structures. The deck 14 at the top of the distantly spaced vertical buoyant caissons 11 and horizontal open frame truss structure 12 bridging their lower ends provides a strong structural load carrying and distributing structural form to the floating structure.

The deck platform 14 can have moon pool 16, since the horizontal truss pontoons 12A are connected between the vertical buoyant caissons 11 underwater and provides an open space at the middle. The deck platform 14 can have multiple levels such as a main deck, twin deck and top deck. The deck platform 14 can support drilling equipment, well completion equipment, risers extending from the well bore at sea bottom and upwardly though the zone of the substructure to the platform, and other well equipment and production equipment and living quarters and also a helicopter landing deck and riser storage deck. In the illustrated examples, mooring lines are shown as being slack, but it should be understood that they might also be tensioned. Also, the dynamic positioning thrusters may be added to replace or to assist the mooring lines in order to do the station keeping of the vessel in the ocean environment. The drilling and or production riser and/or other flexible pipes connecting between the seabed surface and the free water surface may be either supported or pre-tensioned at the upper deck 14 and/or at the underwater portion 11B of the caissons 11 and/or at the open frame truss structure 12.

Figure 3:
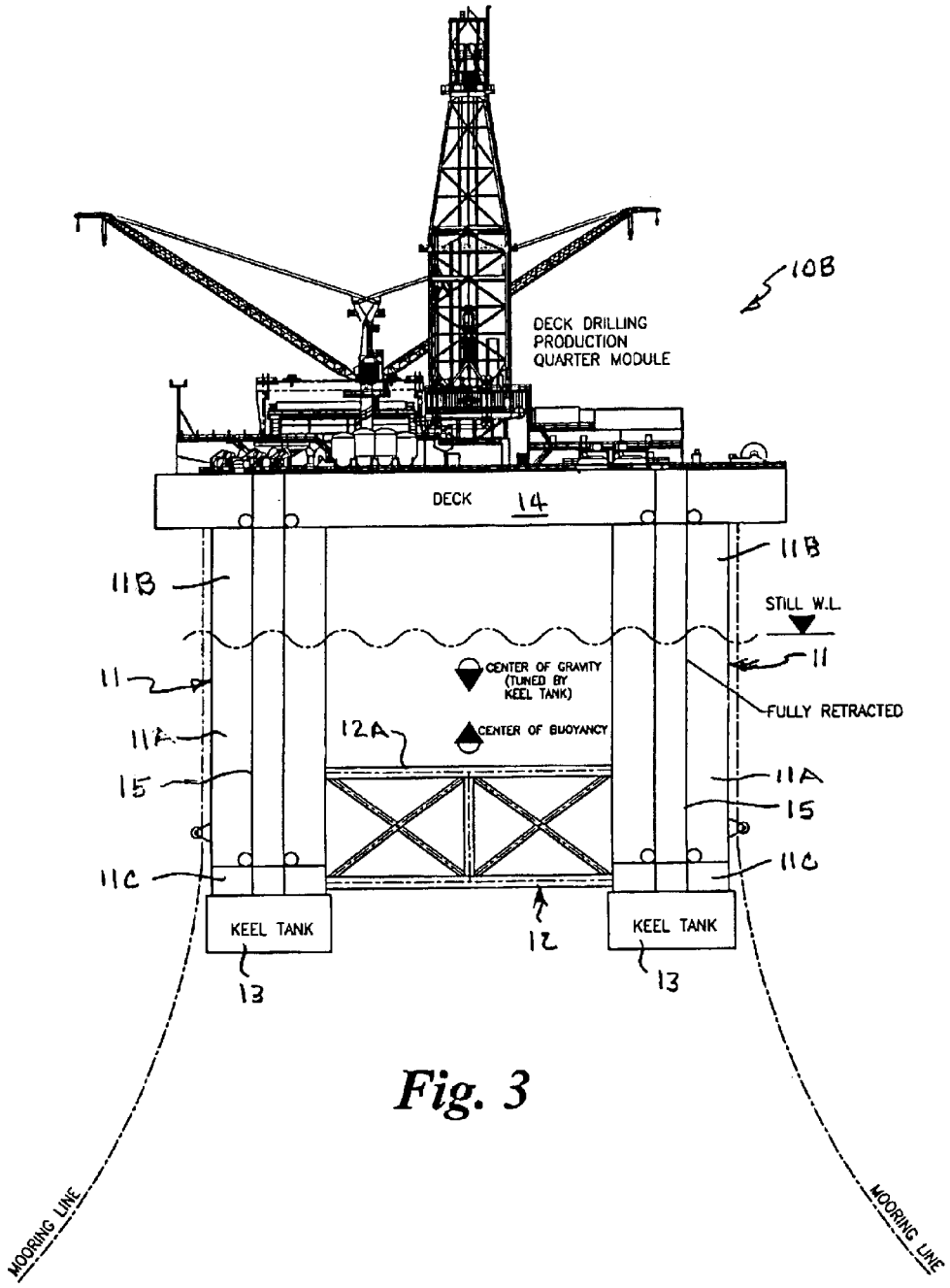
FIG. 3 is a schematic side elevation view of a mobile drilling platform or vessel embodiment of the column-stabilized floating structure with horizontal truss pontoons in accordance with the present invention having a telescopic keel tank arrangement, shown in a retracted position for a mobile condition in water.
Figure 4:
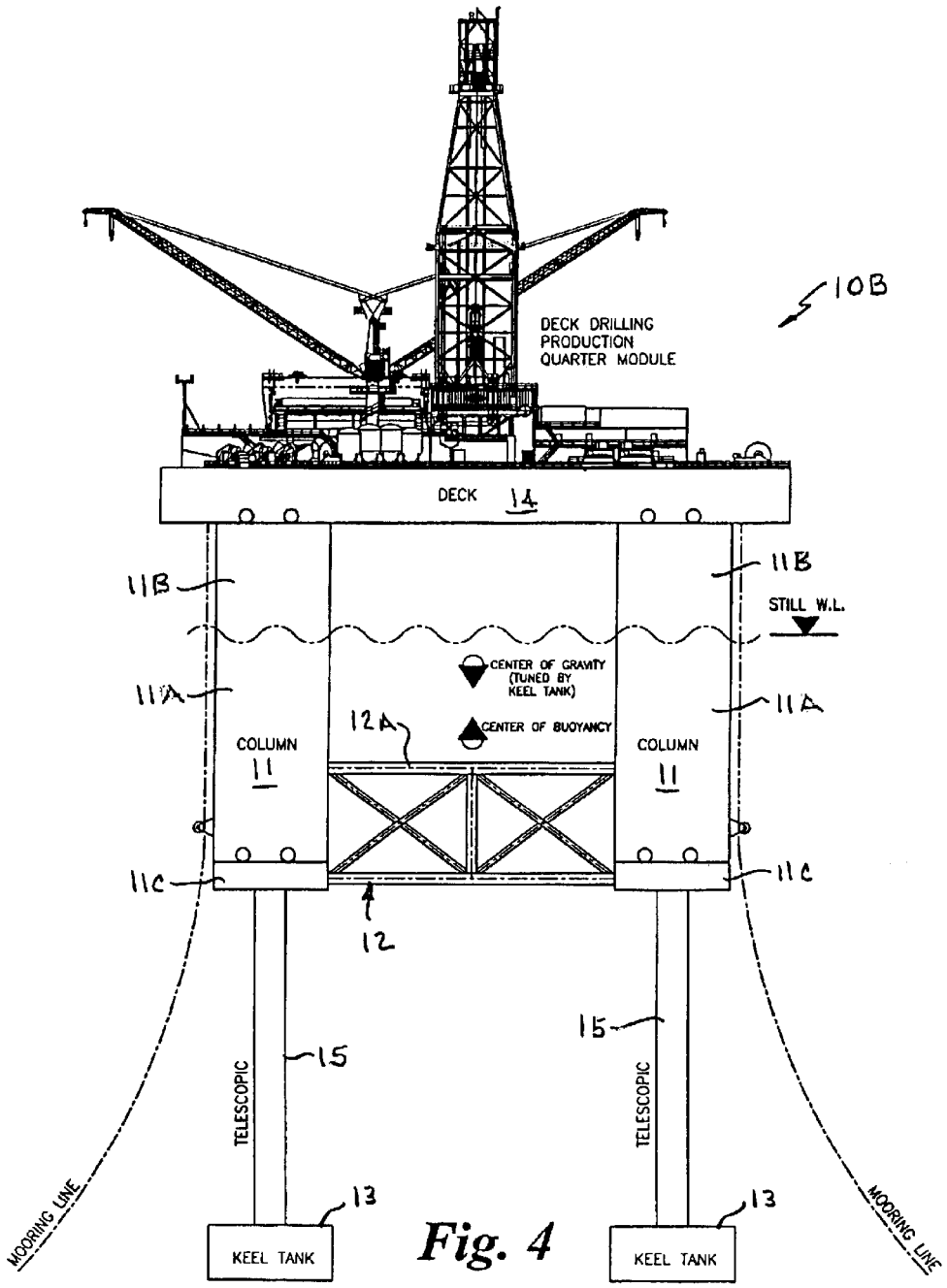
FIG. 4 is a schematic side elevation of the column-stabilized floating structure of FIG. 3, shown with the telescopic keel tanks in an extended position for an operational condition in water.

Referring now to FIGS. 3 and 4, there is shown a modification of the mobile drilling platform or vessel embodiment 10B of the column-stabilized floating structure with truss pontoons, which has a telescopic keel tank arrangement, shown in a transport mode and an operating mode, respectively. The components previous described above are assigned the same numerals of reference, but will not be described in detail again here to avoid repetition. In this modification, the buoyant caissons 11 that are bridged together at their lower ends by the heavy truss framework of the horizontal truss-pontoons 12A are provided with independent vertical trusses, columns or legs 15, that are retractable up and down inside or outside the buoyant caissons, and the keel tanks 13 are supported at the bottoms of the vertical trusses, columns or legs 15, respectively.

In the transit or mobile mode (FIG. 3) of the mobile floating structure 10B, the vertical trusses, columns or legs 12A and keel tanks 13 are retracted up. The buoyancy of the caissons 11 is adjusted to raise the deck 14, caissons, horizontal truss pontoons 12A, and keel tanks 13 upwardly in relation to the seabed to assume a towing draft, and the structure is towed to the operating site. Water may also be selectively pumped into and out of the respective keel tanks 13 to raise or lower the Center of Gravity (C.G) of the entire mass of the floating structure with respect to its Center of Buoyancy (C.B) to achieve maximum stability and motion of the floating structure. The structure 10B is then towed to the operating site.

In the operational drilling condition (FIG. 4), the vertical buoyant caissons 11 are partially submerged and the horizontal truss pontoons 12A bridging them together are situated underwater between the distantly spaced vertical buoyant caissons. The vertical trusses, columns or legs 15 are telescoped down and water is pumped into the keel tanks 14 to achieve the desired buoyancy to adjustably tune the center of gravity (C.G.) of the floating structure 10B with respect to its center of buoyancy (C.B.) for the optimum stability and motion performances at the operating site and to compensate for different operational, environmental survival and other installation stages of the floating structure.

Figure 5:
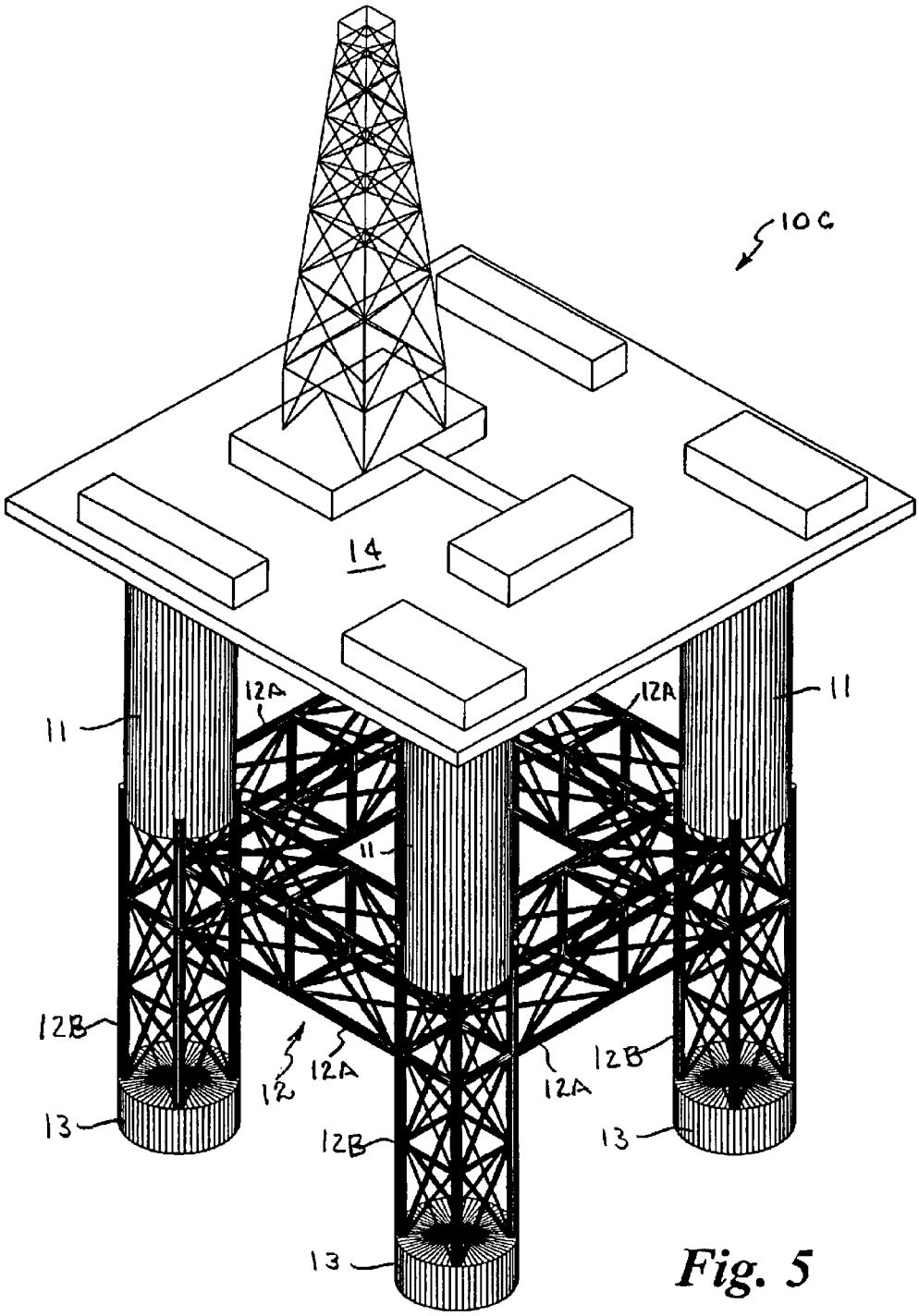
FIG. 5 is a schematic perspective view of an offshore drilling and production platform embodiment of the column-stabilized floating structure with horizontal truss pontoons and vertical truss columns with keel tanks at the bottom thereof that may be permanently installed at a deepwater location.
Figure 6:
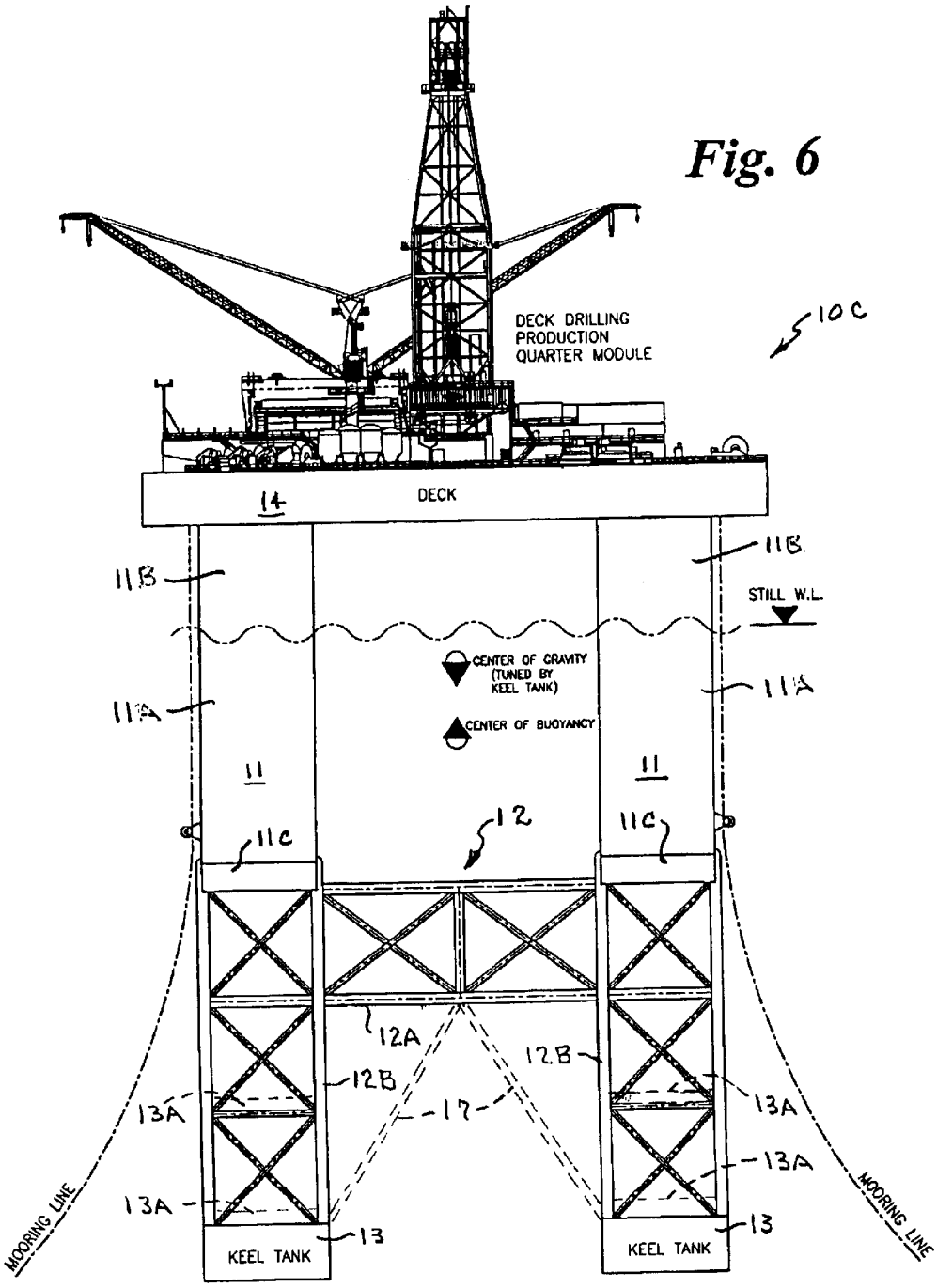
FIG. 6 is a schematic side elevation of the column-stabilized floating structure of FIG. 5.

Referring now to FIGS. 5 and 6, there is shown a preferred column-stabilized floating structure 10C that may be permanently installed at a deepwater location. The components previous described above are assigned the same numerals of reference, but will not be described in detail again here to avoid repetition. In this embodiment, the heavy open frame truss structure 12 at the lower ends of the buoyant caissons 11 includes the horizontal truss pontoons 12A that bridge the caissons together described above, and also a plurality of heavy elongate open frame vertical truss structures formed of slender tubular members, hereinafter referred to as vertical truss columns 12B, each disposed vertically beneath a respective one of the buoyant caissons 11 in axial alignment therewith. The upper portion of the vertical truss columns 12B are connected with the horizontal truss pontoons 12A and their top ends are adapted to receive the lower ends of the buoyant caissons 11, and are secured thereto by welding, bolting, pinning or other conventional assembly methods.

The keel tanks 13 are supported at the bottoms of the vertical truss columns 12B, respectively. The elongate vertical truss columns 12B form elongate open frame extensions of each of the buoyant caissons 11, and position the keel tanks 13 having water pumping capabilities at a selected distance from the lower ends thereof. The length and weight of the vertical truss columns is sufficient to place the Center of Gravity (C.G.) and the Center of Buoyancy (C.B.) of the entire mass of the structure relatively close together. Multiple smaller keel tanks 13A may be supported on the lower portion of each of the vertical truss columns 12B in vertically spaced relation as shown in dashed line in FIG. 6. Diagonal braces 17 may be provided between the horizontal truss pontoons 12A and the lower end of the vertical truss columns 12B to add additional strength and support for the keel tanks 13 as shown in dashed line in FIG. 6.

Figure 7:
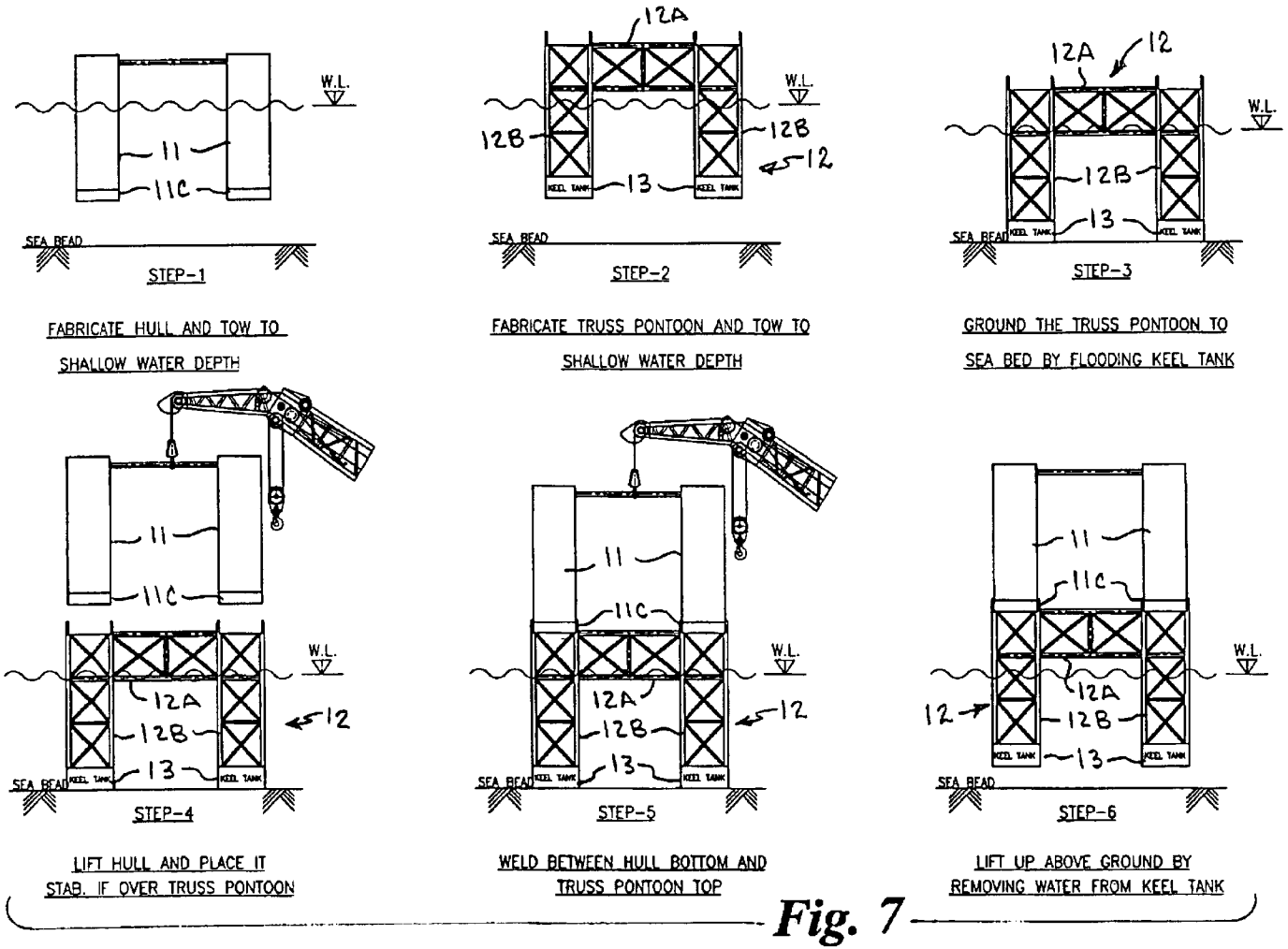
FIGS. 7 and 8 are schematic side elevations illustrating the sequences of installation of the column-stabilized floating structure of FIG. 5 in accordance with a first installation method.
Figure 8:
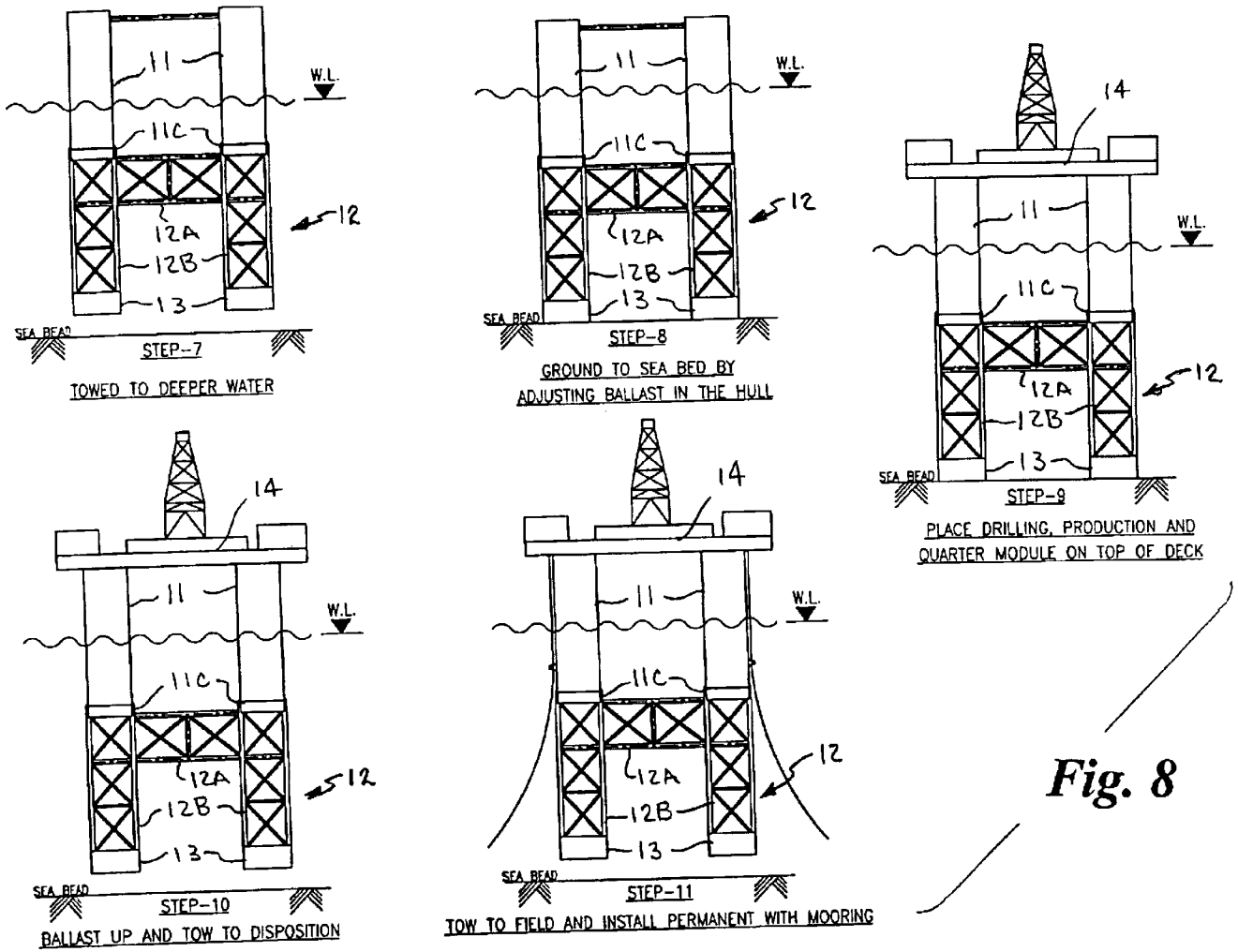

FIGS. 7 and 8 illustrate, schematically, the sequences of a first method of constructing and installing the present column-stabilized floating structure 10C wherein the components are constructed and assembled in shallow water near the shore.

In this method, the hull with the vertical buoyant caissons 11 interconnected together at their top ends in spaced relation is fabricated and towed to a shallow water depth. The open frame truss structure 12 of horizontal truss pontoons 12A and vertical truss columns 12B with keel tanks 13 at the lower ends thereof is fabricated and towed to the shallow water depth. The keel tanks 13 are flooded such that the open frame truss structure 12 and keel tanks 13 are grounded on the seabed at the shallow water depth. The hull (interconnected caissons 11) is lifted above the open frame truss structure 12 and then lowered to engage the lower ends of the vertical buoyant caissons 11 on the vertically spaced truss columns 12B. The spaced apart vertical buoyant caissons 11 of the hull are then secured to the upper ends of the vertical truss columns 12B of the open frame truss structure 12. Water is pumped out of the keel tanks 13 to raise the hull and open frame truss structure and keel tanks 13 upwardly in relation to the seabed, and the assembled structure is towed to deeper water. The buoyancy of the hull (caissons 11) is adjusted to ground the open frame truss structure 12 and keel tanks 13 on the seabed at the deeper water depth. The deck platform 14 is installed on the upper ends of the vertical buoyant caissons 11. The buoyancy of the hull (caissons 11) is adjusted to raise the hull with deck platform 14, open frame truss structure 12 and keel tanks 13 upwardly in relation to the seabed to assume a towing draft, and the assembled structure is towed to the deepwater operating site.

Figure 9:
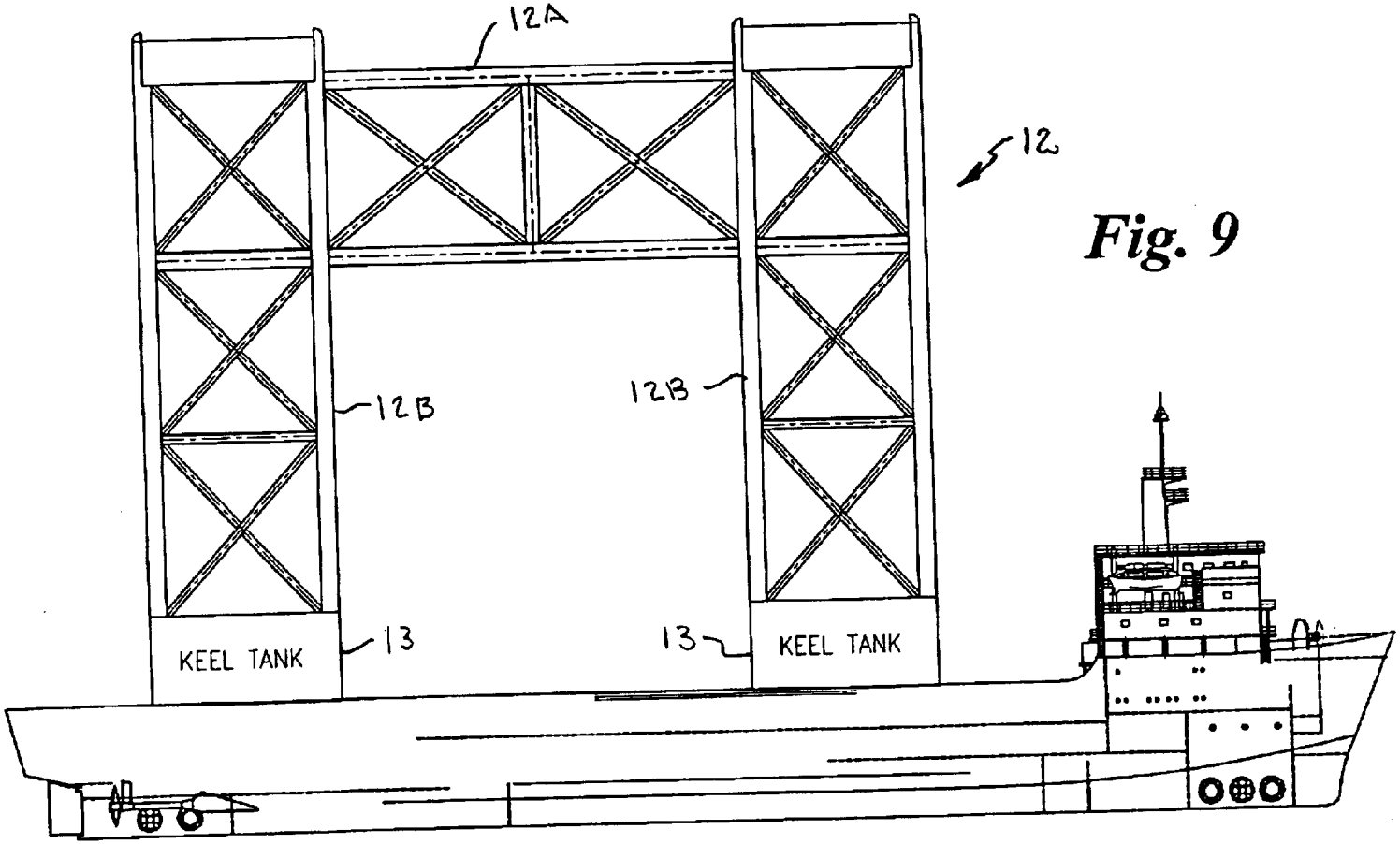
FIGS. 9, 10 and 11 are schematic side elevations illustrating the sequences of installation of the column-stabilized floating structure of FIG. 5 in accordance with a second installation method.
Figure 10:
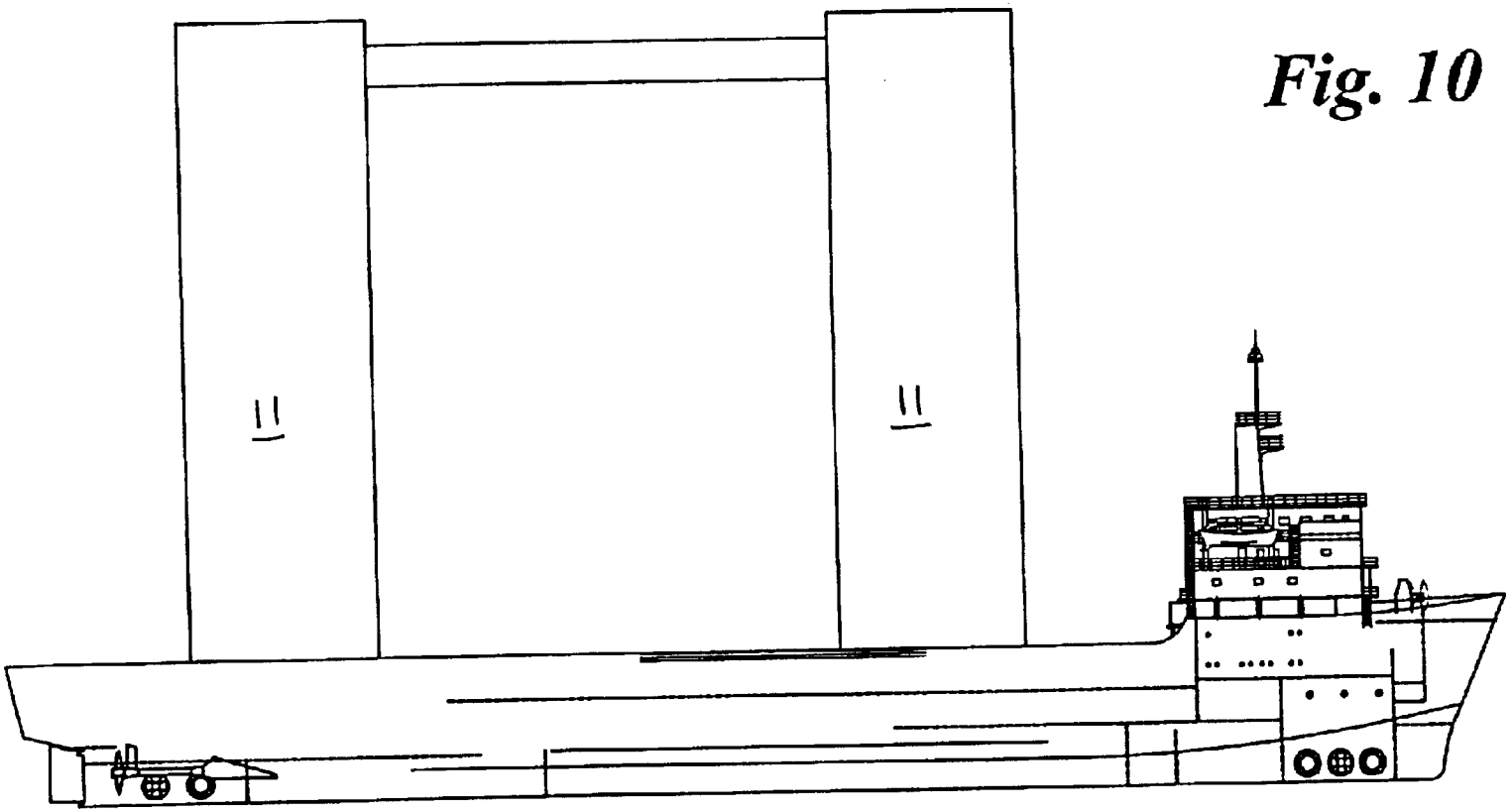
Figure 11:
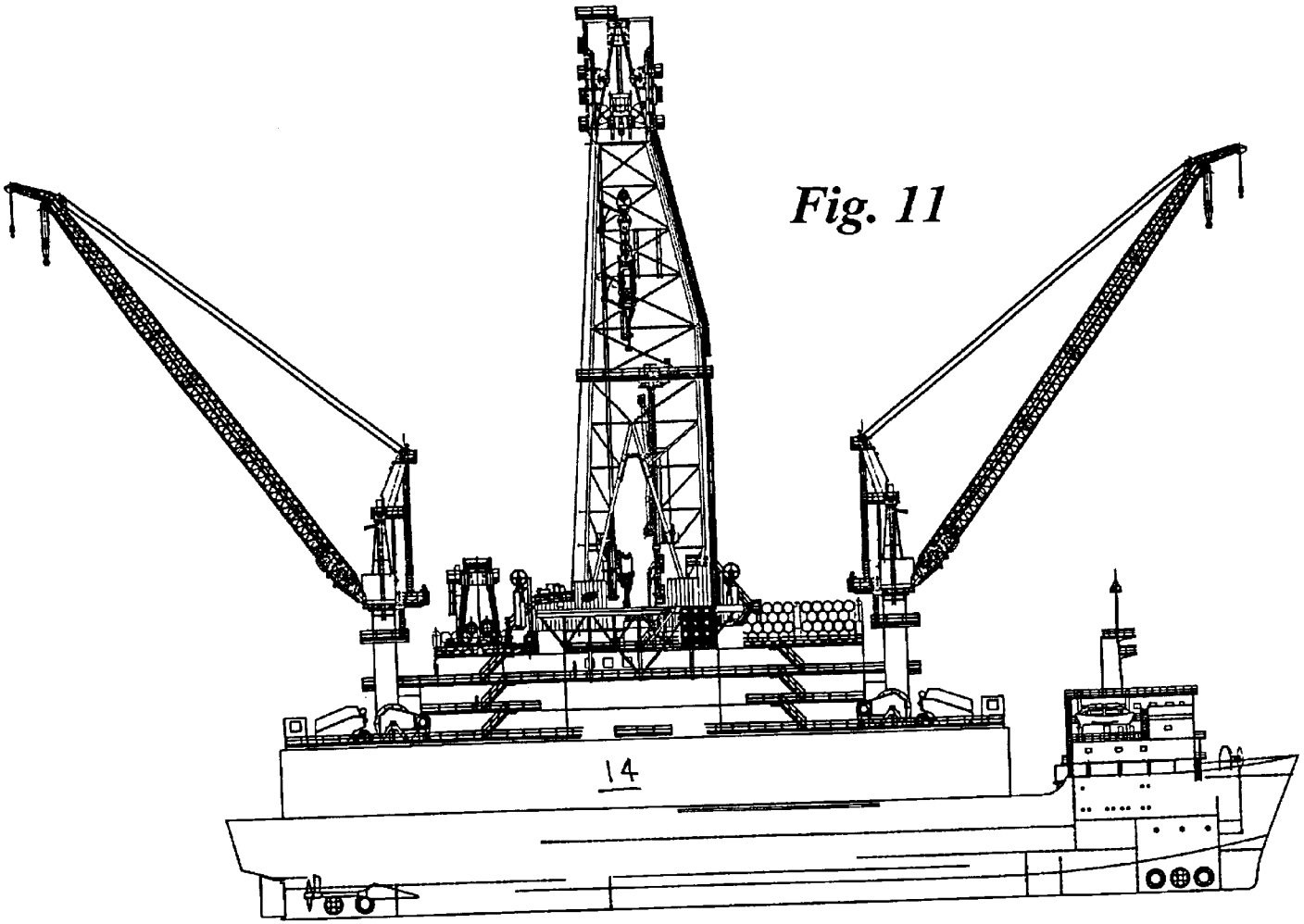

FIGS. 9, 10 and 11 illustrate, schematically, the sequences of a second method of constructing and installing the present column-stabilized floating structure 10C in deep water. In this method, the hull with spaced apart interconnected vertical buoyant caissons 11 and keel tanks 13, and the deck platform 14 to be installed at the upper end thereof are fabricated in dry dock and are transported via towing or on a barge or ship to a deepwater operating site. The open frame truss structure 12 with keel tanks 13 is placed into the water and the keel tanks arc flooded such that the open frame truss structure and keel tanks are submerged beneath the water surface and their upper ends are above the water surface. The hull (interconnected vertical buoyant caissons, 11) is then lifted above the upper ends of the open frame truss structure and then lowered to engage the caissons on the open frame truss structure 12, and the deck platform 14 is secured thereto. Referring again to FIG. 6, the buoyancy of the hull (caissons 11) is adjusted to lower the upper hull and truss structure 12 with keel tanks 13 such that the open frame truss structure and keel tanks are submerged beneath the water surface and the vertical buoyant caissons 11 of the upper hull are partially submerged.

The deck platform 14 is lifted above the upper ends of the vertical buoyant caissons 11 and lowered to engage the upper ends of the caissons, and the deck platform is secured to the upper ends of the vertical buoyant caissons. Thereafter, the buoyancy of the hull (caissons 11) is adjusted to raise the hull with deck platform 14 and open frame truss structure 12 with keel tanks 13 upwardly to operating draft.

After the present floating structures have been installed by either method, the water mass of the keel tanks 13 and weight of the structure can be adjustably tuned to raise or lower the center of gravity (C.G.) of the entire mass of the structure with respect to its center of buoyancy (C.B.) according to ballast and variable or fixed loads including deck payloads, to stabilize the structure, and to compensate for different operational, environmental, survival and installation stages of the structure.

Figure 12:
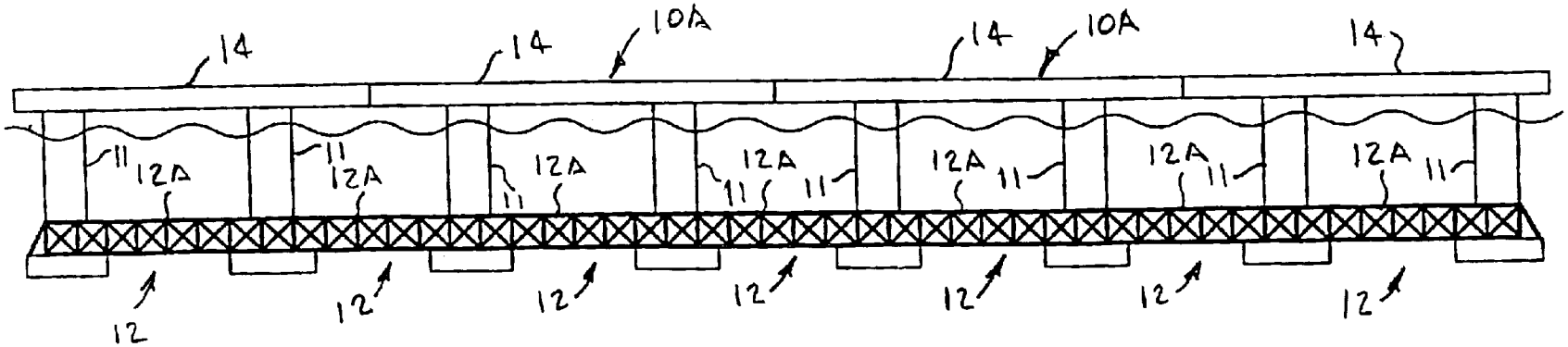
FIG. 12 is a schematic side elevation of a plurality of column-floating structures of the embodiment of FIG. 1, having their deck connected together to form a large column-stabilized floating offshore structure capable of use as a floating airport, port, bridge or mobile offshore base.
Figure 13:
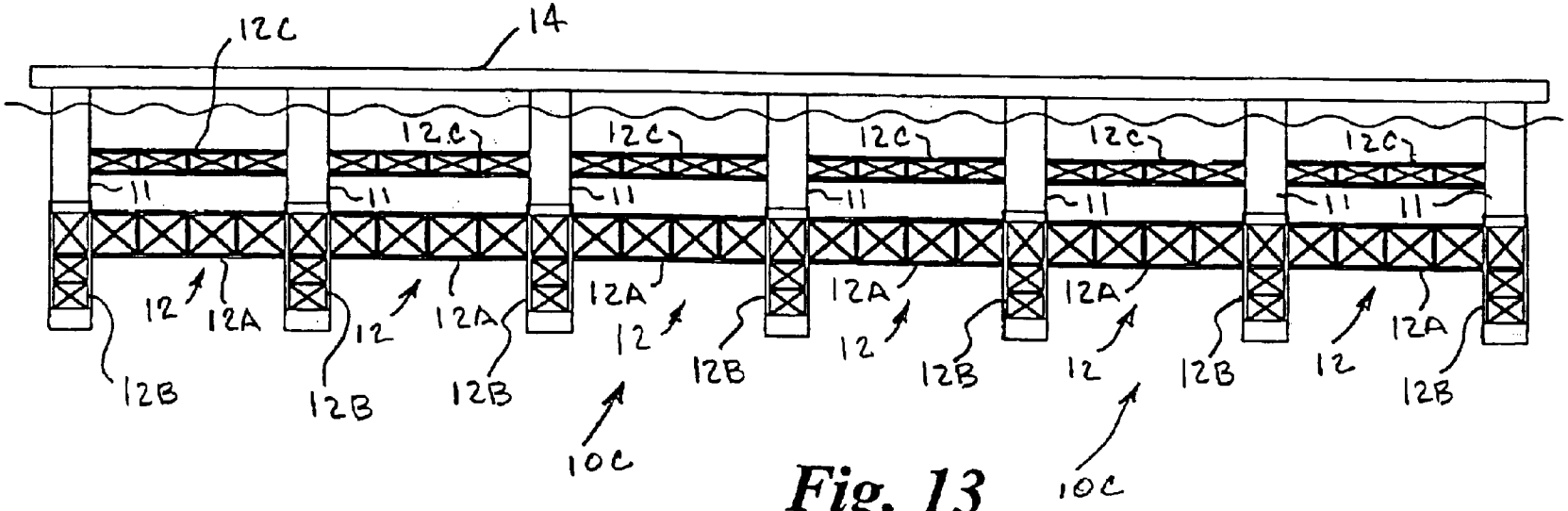
FIG. 13 is a schematic side elevation of a plurality of column-floating structures of the embodiment of FIG. 5, having their deck connected together to form a large column-stabilized floating offshore structure capable of use as a floating airport, port, bridge or mobile offshore base.

The present column-floating structures may also be utilized for other offshore floating structures applications. For example, FIG. 12 shows schematically a plurality of the structures 10A of the embodiment of FIG. 1, each having a deck platform 14 secured to an upper end of the spaced apart vertical buoyant caissons 11 wherein the caissons are connected together by horizontal truss pontoons 12A and the deck platforms are connected together to form a large column-stabilized floating offshore structure capable of use as a floating airport, port, bridge or mobile offshore base. FIG. 13 shows schematically a plurality of the structures 10C of the embodiment of FIG. 5, wherein the caissons 11 are connected together by horizontal truss pontoons 12A and a single deck platform 14 is secured to the upper ends of the spaced apart vertical buoyant caissons 11 to form a large column-stabilized floating offshore structure capable of use as a floating airport, port, bridge or mobile offshore base. In FIG. 13, there is also shown a second, or upper, open framework of horizontal truss pontoons 12C connected to the vertical buoyant caissons 11 intermediate their upper and lower ends interconnecting them together in spaced apart relation.

Principles of Stability and Motion

The present Column Stabilized Truss Pontoon structure is a freely floating body with an interface between water and air at each column in its operating position. The weight of the body is balanced by the buoyant forces from the columns, from the keel tanks and from other intermediate tanks positioned on the truss columns. The center of gravity and the center of buoyancy for the floating body are defined above. The distance between the center of gravity with respect to the bottom most reference point (say keel) is called KG and the distance between the center of buoyancy with respect to the bottom most reference point (say keel) is called KB. The point M, which is called "metacenter", is defined as the intersection of two lines of action of the force of buoyancy at two inclinations of the free floating body a small angle apart. The metacenter will lie on the centerline of the body for small angles of inclination from the upright position. The distance of the metacenter from the same reference point at the keel is called KM. The length, GM=(KM−KG) is a very important parameter in determining the stability and the motion characteristics of the free floating body. It also can be thought of as a point of suspension of an equivalent simple pendulum of weight W and length GM, whose period of oscillations is equal to that of the body in unresisted free rolling motion.

In the present invention, the center of gravity of the vessel is lowered adequately relative to the center of buoyancy, but still it can be above the center of buoyancy. For the given KB value, the GM value can be reduced by tuning the KG value with the weight of the keel tanks and with the weight of intermediate tanks, in the case of the vertical truss column concept. The GM is given by GM=KB+(I/V)−KG, where I=the area moment of inertia of the water plane (second moment of area) about an axis of rotation ($m^4$), and V=volume of the water displacement of the free floating body ($m^3$). The circular frequency of the rotational motion (Roll/Pitch) $\omega_n$ is given by the following formula as:

$$\omega_n=\sqrt{(g*GM/(KG^2))}$$

where g=9.807 m/sec$^2$. For stability requirements the GM should be a positive nonzero value. The larger the value of the GM, the safer is the body. However, the body having the larger metacentric height will oscillate with higher circular frequency $\omega_n$, that is the motion will be severe with higher acceleration and less comfortable. The higher acceleration is also a potential danger for structural integrity failure. Thus in the present invention, the GM value is lowered to the required value which satisfies both the adequate stability and softer motion requirements by adjusting the location of the center of gravity with respect to the keel by tuning the masses in the keel tanks. The common good range of GM value controlled in the conventional semi-submersible vessel concept is 1 m–4 m.

In principle in the present invention, the shell pontoons which normally provide the majority of the buoyancy to the conventional semi-submersible concept are eliminated and replaced by the present horizontal truss pontoons and the majority buoyancy is obtained from the vertical truss columns themselves by designing the partially submerged vertical columns/caissons sufficiently long and large. This significantly reduces the vertical wave exiting forces on the free-floating vessel. In the case of the conventional semi-submersible, the center of gravity is brought down by accommodating maximum possible weights in the submerged pontoon. Thus the circular frequency of the rotational motion (Roll/Pitch) $\omega_n$ of the conventional semi-submersible concept is lowered well below the usual ocean wave frequencies. In the present invention, the KG (location of the center of gravity with respect to the keel of the vessel) is lowered by tuning the mass of the keel tanks and by keeping the keel tanks distantly apart well below the horizontal, truss pontoons with the help of the vertical truss column structures. Thus the GM and the KG values are adjusted for the optimum stability requirements and motion performances of the present invention. The water plane areas provided by the vertical truss columns and the area moment of inertia of the water plane provides the restoring moment required for the stability of the free floating structure of the present invention.

Advantages of the present Column-Stabilized Floating Structure with Truss Pontoons Some of the significant differences and advantages of the present column-stabilized floating structures with over conventional deep draft semi-submersible and tension leg platform (TLP) structures are described below.

The open frame truss structure 12 of the present column-stabilized floating structures provides significantly less underwater surface area subject to wave forces in the vertical and horizontal directions than conventional semi-submersibles. Thus, the present structure will be less susceptible to heave, pitch and roll motions. Conventional semi-submersibles have large heave motion to waves and dry-tree production is not recommended for semi-submersibles.

When the present column-stabilized floating structure is used as a Tension Leg Platform (TLP), the vertical wave forces are reduced and the platform can be extended for further deeper water installations than conventional TLP's used currently.

The present column-stabilized floating structures are mobile and can be moved or towed to different locations. Conventional TLP are not mobile and cannot be moved after it is installed. The present floating structures cost less to install than conventional TLPs. The size of the vessel and the size of the tendons become very large in the case of the conventional TLPs. The present truss pontoon structure can be extended for deeper water depth and thereby reduce the natural frequency of the heave and the heave forces.

The present column-stabilized floating structures also have significant differences and advantages over conventional SPAR structures. The present structure is insensitive to the location of the Center of Gravity (C.G.) and location of the Center of Buoyancy (C.B.) within a large range. A conventional SPAR is designed such that the Center of Gravity (C.G.) is required to be situated below the Center of Buoyancy (C.B.) for stability. This is because of the single or closely spaced multiple deep draft vertical columns or caissons. In order for the SPAR to achieve static stability, the Center of Buoyancy (C.B.) is above and the sum of buoyancy forces acts above at the Center of Buoyancy (C.B.), and the Center of Gravity (C.G.) is below the center of buoyancy (C.B.) and the sum of the weight acts downward. Since it is either a single vertical column or multiple closely spaced columns or caissons the principle of stability is same.

With the present column-stabilized floating structures, the Center of Gravity (C.G.) can be above the Center of Buoyancy (C.B.) and still maintain stability like a semi-submersible due to the distantly spaced multiple vertical caissons (three or more), which are designed with a water plane area and area moment of inertia with respect to the axes on the water plane. Thus, the present invention is a column-stabilized floating structure with a truss pontoon structure and has a different principal of stability and operation than the SPAR concept.

With regard to providing dry or wet tree applications of oil production from deepwater, dry tree production is possible if the heave, roll, and pitch responses to wave environments are significantly lower or comparable to a TLP or SPAR. Because of the reduced surface area exposed to the wave forces due to the present open frame truss pontoon structure, the heave of the present floating structures is very attractive like a SPAR and the pitch and roll motions responsive to the waves are like the semi-submersibles. Thus the present floating structures have the optimum motion characteristics to accept both dry and wet tree production systems.

The conventional SPAR has limited deck area and payload because it is a single vertical column. The conventional SPAR also creates a large radius of gyration of the deck mass about the center of its column and creates large instability. The present floating structures, on the other hand, can have a large deck area and payload carrying capacity.

Compared to semi-submersible or TLP structures, the payload to displacement ratio of the present floating structures is large. This is because the conventional stiffened shell type pontoon is efficiently replaced by the more efficient open frame truss structure. The extra ballast and the pumps and pipes required to control ballast in the conventional pontoon are eliminated. Thus, unwanted weight and equipment costs are reduced as well as engineering and fabrication costs.

The elimination of the stiffened shell type pontoon reduces the design complexity of the present truss pontoon/column intersection connections and their design complexity. Simple well established easily welded frame connections like a fixed jacket platform can be used. Because of the reduced underwater hull structure required by conventional pontoons with stiffened shells, the fabrication cost is reduced and can be cost and time effectively fabricated in U.S. shipyards.

The reduced motions of the present floating structures compared to semi-submersible, SPAR and TLPs reduce the station keeping, mooring or dynamic positioning (DP) or tendon cost. In the case of using the present column-stabilized floating structure 10C in deepwater applications, the vertical motions are reduced due to the reduced vertical surface area. Secondly, the surface area provided by the present truss pontoon structure contributes towards the inertia wave forces and the surface area contributed by the truss structure is a drag dominated wave force component. The drag and inertia component of the wave forces are 90° out of phase. Also, the drag component helps dissipate the energy in the water with the oscillation of the floating structure and thereby acts like a damper in the dynamics of the floating structure. Thus it is naturally advantageous to the mooring or station keeping resistance forces and thus reduces the cost.

In the conventional semi-submersible design, all feasible equipment, weights and liquid storages are placed underwater, particularly in the lowermost underwater level in the columns or caissons to place the Center of Gravity (C.G.) as low as possible relative to the Center of Buoyancy (C.B.). With the present invention, the center of gravity (C.G.) can be lowered to the desired position by pumping water into the keel tanks and allows placement of all the equipment on the top of the deck where it is easy to access and work with. Thus, the cost of operation, maintenance and control is reduced.

With the present floating structures, the size of the buoyant caissons is smaller than the conventional SPAR structures and is supported both at the top and bottom. Thus, the vortex-induced vibrations (VIV) are not severe like a conventional SPAR.

The conventional SPAR is a large diameter single column or closely spaced multiple column vessel and has to be fabricated in a horizontal position, transported on a barge to the field in the horizontal position, upended at its operating location within the weather window, and thereafter the deck is installed also within the weather window. The risk of failure during the upending and deck installation within the weather window is very high for a SPAR type of structure. The present floating structures are fabricated and assembled in a vertical and upright position and towed also in an upright position to the operating location. Thus the risk and cost of installation is reduced significantly.

Because of the elimination of conventional shell-to-shell type connections and the reduced stress concentrations of the present open frame truss structure, the fatigue life of the underwater structure is enhanced.

The maintenance and inspection cost of the present floating structures is reduced due to the elimination of the conventional shell type stiffened plated box type pontoon and by using the open frame truss pontoon structure.

The cost of topside hookup and man-hours during installation activities are large with conventional SPAR structures due to the reduced deck area. The present floating structures provide a large deck area with reduced motion characteristics and reduces hookup and costly man-hours during offshore installation.

Since the column truss pontoon invention is very insensitive to the wave environment with insignificant heave and roll responses, the concept applications can be extended to applications like floating airport, port, bridge or mobile offshore base. The multiple of column stabilized units can be tied together or fabricated as one unit to form a floating airport, port, bridge or mobile offshore base.

While this invention has been described fully and completely with special emphasis upon preferred embodiments, it should be understood that within the scope of the appended claims the invention may be practiced otherwise than as specifically described herein.

What is claimed is:

1. A column-stabilized floating offshore structure, comprising:

a plurality of spaced apart vertical buoyant caissons;

an open framework of horizontal spaced truss pontoon members interconnecting lower ends of said caissons together in spaced apart relation;

each of said vertical caissons having a submerged portion and a non-submerged portion and one or more buoyant tanks or chambers enclosed by bulkheads or disposed inside said each of said caissons including ballast control means for selectively adjusting the buoyancy thereof;

one or more keel tanks disposed beneath said horizontal truss pontoon members including pump control means for selectively pumping water in and out of said keel tanks to adjust the weight thereof; wherein;

the water mass and weight of said keel tanks is adjustably tuned to raise or lower the center of gravity (C.G.) of the entire mass of the structure with respect to its center of buoyancy (C.B.) according to ballast and variable or fixed loads including deck payloads, to stabilize the structure, and to compensate for different operational, environmental, survival and installation stages of the structure.

2. A column-stabilized floating offshore structure according to claim 1, further comprising:

a work deck platform secured to an upper end of said plurality of spaced apart vertical buoyant caissons, selected from the group consisting of box, truss, or frame type construction.

3. A column-stabilized floating offshore structure according to claim 2, further comprising:

a moon pool on said work deck platform.

4. A column-stabilized floating offshore structure according to claim 1, further comprising:

a plurality of said structures as defined in claim 1; and at least one deck platform secured to an upper end of said plurality of spaced apart vertical buoyant caissons, selected from the group consisting of box, truss, or frame type construction, to form a large column-stabilized floating offshore structure capable of use as a floating airport, port, bridge or mobile offshore base.

5. A column-stabilized floating offshore structure according to claim 1, wherein said keel tanks are telescopically connected with said lower ends of said caissons and are selectively retractable and extensible relative thereto between a transport mode and an operating mode; wherein in the transport mode said keel tanks are retracted for transporting said structure offshore by towing or by carrying via a transportation barge, and in the operating mode said keel tanks are extended, arid water is pumped into said keel tanks to adjust the water mass and weight thereof to achieve a desired buoyancy and adjustably tune the center of gravity (C.G.) of said structure relative to its center of buoyancy (C.B.) for optimum stability and motion performance.

6. A column-stabilized floating offshore structure according to claim 5, further comprising:

a work deck platform secured to an upper end of said plurality of spaced apart vertical buoyant caissons, selected from the group consisting of box, truss, or frame type construction.

7. A column-stabilized floating offshore structure according to claim 6, further comprising:

a moon pool on said work deck platform.

8. A column-stabilized floating offshore structure according to claim 5, further comprising:

a plurality of said structures as defined in claim 5; and at least one deck platform secured to an upper end of said plurality of spaced apart vertical buoyant caissons, selected from the group consisting of box, truss, or frame type construction, to form a large column-stabilized floating offshore structure capable of use as a floating airport, port, bridge or mobile offshore base.

9. A column-stabilized floating offshore structure according to claim 1, further comprising:

a plurality of open framework vertical truss column members each connected at an upper end with said horizontal truss pontoon members and extending a distance therebelow in axial alignment with a respective one of said buoyant caissons; and said keel tanks are connected with lower ends of said vertical truss columns; wherein the length and weight of said vertical truss columns is sufficient to place the center of gravity (C.G.) and the center of buoyancy (C.B.) of the entire mass of the structure relatively close together; and water is selectively pumped into and out of said keel tanks to adjust the water mass and weight thereof to achieve a desired buoyancy and adjustably tune the center of gravity (C.G.) of said structure relative to its center of buoyancy (C.B.) for optimum stability and motion performance.

10. A column-stabilized floating offshore structure according to claim 9, further comprising:

a work deck platform secured to an upper end of said plurality of spaced apart vertical caissons, selected from the group consisting of box, truss, or frame type construction.

11. A column-stabilized floating offshore structure according to claim 10, further comprising:

a moon pool on said work deck platform.

12. A column-stabilized floating offshore structure according to claim 9, further comprising:

auxiliary keel tanks on said vertical truss column members disposed in vertically spaced relation.

13. A column-stabilized floating offshore structure according to claim 9, further comprising:

brace members extending diagonally between said horizontal truss pontoons and lower ends of said vertical truss columns to provide additional strength and lateral support for said keel tanks.

14. A column-stabilized floating offshore structure according to claim 9, further comprising:

a plurality of said structures as defined in claim 9; and at least one deck platform secured to an upper end of said plurality of spaced apart vertical buoyant caissons, selected from the group consisting of box, truss, or frame type construction, to form a large column-stabilized floating offshore structure capable of use as a floating airport, port, bridge or mobile offshore base.

15. A column-stabilized floating offshore structure according to claim 14, further comprising:

a second open framework of horizontal spaced truss pontoon members connected to said plurality of spaced apart vertical buoyant caissons intermediate their said upper and lower ends interconnecting them together in spaced apart relation.

16. A method of fabricating, transporting, installing, and operating a floating offshore structure, the structure including an upper hull having a plurality of spaced apart vertical buoyant caissons interconnected together in spaced relation by an open framework of horizontal truss pontoon members and vertical truss column members, each of said caissons having one or more buoyant tanks or chambers enclosed by bulkheads or disposed inside said caissons including ballast control means for selectively adjusting the buoyancy thereof, and one or more keel tanks disposed at a lower end of said truss structures including pump control means for selectively pumping water in and out of said keel tanks to adjust the weight thereof; comprising the steps of:

fabricating the upper hull with a plurality of spaced apart vertical buoyant caissons interconnected together in spaced relation and towing it to a shallow water depth;

fabricating the open framework of horizontal truss pontoon members and vertical truss columns with keel tanks at a lower end thereof and towing it to the shallow water depth;

flooding said keel tanks such that the open framework of horizontal truss pontoon members, vertical truss columns, and keel tanks are grounded on the seabed at the shallow water depth;

lifting the upper hull above said open framework of horizontal truss pontoon members and vertical truss columns and lowering it to engage its spaced apart vertical buoyant caissons on the vertical truss columns;

securing the spaced apart vertical buoyant caissons of the upper hull to the horizontal truss pontoon members and vertical truss columns;

pumping water out of said keel tanks to raise the upper hull and framework of horizontal truss pontoon members and vertical truss columns and keel tanks upwardly in relation to the seabed;

towing the assembled structure to deeper water;

adjusting the buoyancy of said upper hull to ground the open framework of horizontal truss pontoon members and vertical truss columns and keel tanks on the seabed at the deeper water depth;

installing a deck platform to the upper end of said plurality of spaced apart vertical buoyant caissons;

adjusting the buoyancy of said upper hull to raise the deck platform, upper hull, and framework of horizontal truss pontoon members and vertical truss columns and keel tanks upwardly in relation to the seabed to assume a towing draft; and towing the assembled structure to an operating site.

17. The method according to claim 16, including the further steps of:

adjustably tuning the water mass and weight of said keel tanks to raise or lower the center of gravity (C.G.) of the entire mass of the structure with respect to its center of buoyancy (C.B.) according to ballast and variable or fixed loads including deck payloads, to stabilize the structure, and to compensate for different operational, environmental, survival and installation stages of the structure.

18. The method according to claim 16, wherein said keel tanks are telescopically mounted on said open framework of horizontal truss pontoon members and vertical truss columns and are selectively retractable and extensible relative thereto between a transport mode and an operating mode; and said step of adjusting the buoyancy of said upper hull includes the step of extending or retracting said keel tanks to adjustably tune the center of gravity (C.G.) of said structure relative to its center of buoyancy (C.B.) for optimum stability and motion performance; and said step of adjusting the buoyancy of said upper hull draft to assume a towing draft includes the step of retracting said keel tanks.

19. The method according to claim 16, including the further steps of;

providing a plurality of said structures as defined in claim 14, each having a deck platform secured to an upper end of said plurality of spaced apart vertical buoyant caissons; and connecting each of said deck platforms together to form a large column-stabilized floating offshore structure capable of use as a floating airport, port, bridge or mobile offshore base.

20. A method of fabricating, transporting, installing, and operating a floating offshore structure, the structure including an upper hull having a plurality of spaced apart vertical buoyant caissons interconnected together in spaced relation by an open framework of horizontal truss pontoon members and vertical truss columns, each of said caissons having one or more buoyant tanks or chambers enclosed by bulkheads or disposed inside said caissons including ballast control means for selectively adjusting the buoyancy thereof, and one or more keel tanks disposed at a lower end of said horizontal truss pontoon members and vertical truss columns including pump control means for selectively pumping water in and out of said keel tanks to adjust the weight thereof; comprising the steps of:

fabricating, in dry dock, the open framework of horizontal truss pontoon members and vertical truss columns with keel tanks at a lower end thereof, the upper hull with a plurality of spaced apart vertical buoyant caissons interconnected together in spaced relation, and a deck platform to be installed at the upper end of said plurality of spaced apart vertical buoyant caissons;

transporting the open framework of horizontal truss pontoon members and vertical truss columns with keel tanks, the upper hull, and the deck platform, via towing or barge to a deepwater operating site;

placing said open framework of horizontal truss pontoon members and vertical truss columns and keel tanks into the water and flooding said keel tanks such that the open framework of horizontal truss pontoon members and vertical truss columns and keel tanks are submerged beneath the water surface and their upper ends are above the water surface;

lifting the upper hull above the upper ends of said open framework of horizontal truss pontoon members and vertical truss columns and lowering it to engage its spaced apart vertical buoyant caissons on the vertical truss columns;

securing the spaced apart vertical buoyant caissons of the upper hull to the horizontal truss pontoon members and vertical truss columns;

adjusting the buoyancy of said upper hull to lower the upper hull and framework of horizontal truss pontoon members and vertical truss columns and keel tanks such that the open framework of horizontal truss pontoon members and vertical truss columns and keel tanks are submerged beneath the water surface and the vertical buoyant caissons of the upper hull are partially submerged;

lifting the deck platform above the upper ends of the vertical buoyant caissons and lowering it to engage the upper ends of the vertical buoyant caissons;

securing the deck platform to the upper ends of the spaced apart vertical buoyant caissons; and adjusting the buoyancy of said upper hull to raise the deck platform, upper hull, and framework of horizontal truss pontoon members and vertical truss columns and keel tanks upwardly to operating draft.

21. The method according to claim 20, including the further steps of:

adjustably tuning the water mass and weight of said keel tanks to raise or lower the center of gravity (C.G.) of the entire mass of the structure with respect to its center of buoyancy (C.B.) according to ballast and variable or fixed loads including deck payloads, to stabilize the structure, and to compensate for different operational, environmental, survival and installation stages of the structure.

22. The method according to claim 20, wherein said keel tanks are telescopically mounted on said open framework of horizontal truss pontoon members and vertical truss columns and are selectively retractable and extensible relative thereto between a transport mode and an operating mode; and said step of adjusting the buoyancy of said upper hull to operating draft includes the step of extending or retracting said keel tanks to adjustably tune the center of gravity (C.G.) of said structure relative to its center of buoyancy (C.B.) for optimum stability and motion performance.

23. The method according to claim 20, including the further steps of;

providing a plurality of said structures as defined in claim 20, each having a deck platform secured to an upper end of said plurality of spaced apart vertical buoyant caissons; and connecting each of said deck platforms together to form a large column-stabilized floating offshore structure capable of use as a floating airport, port, bridge or mobile offshore base.

* * * * *